United States Patent [19]

Corriero

[11] 4,333,181

[45] Jun. 8, 1982

[54] PROTECTIVE STRUCTURES FOR JOINTS

[76] Inventor: John Corriero, 310 Greenwich St.-Apt. 35J, New York, N.Y. 10013

[21] Appl. No.: 150,597

[22] Filed: May 16, 1980

[51] Int. Cl.[3] ..... A41D 13/06

[52] U.S. Cl. ..... 2/24; 128/80 C

[58] Field of Search ..... 2/22, 24; 128/80 C

[56] References Cited

U.S. PATENT DOCUMENTS

| | | | |
|---|---|---|---|
| 1,293,240 | 2/1919 | Summers | 2/24 |
| 1,753,055 | 4/1930 | Matheson | 2/24 |
| 1,772,922 | 8/1930 | Volz | 2/22 |
| 1,796,234 | 3/1931 | Bassett | 2/24 |
| 2,456,472 | 12/1948 | Turner | 2/24 |
| 3,015,103 | 1/1962 | Zbikowski | 2/416 |
| 3,259,910 | 7/1966 | Daignoult | 2/24 |
| 3,712,299 | 6/1973 | Voehl | 2/24 X |
| 3,742,517 | 7/1973 | Bednarczuk et al. | 2/24 X |
| 3,945,047 | 3/1976 | Jarrell | 2/24 |
| 4,097,932 | 7/1978 | Lacey | 2/24 |

FOREIGN PATENT DOCUMENTS

| | | | |
|---|---|---|---|
| 2710430 | 9/1978 | Fed. Rep. of Germany | 2/24 |
| 981718 | 1/1951 | France | 2/24 |
| 2421638 | 12/1979 | France | 2/24 |
| 623172 | 5/1949 | United Kingdom | 2/24 |

*Primary Examiner*—Louis Rimrodt

*Attorney, Agent, or Firm*—John A. Shedden

[57] ABSTRACT

A protective structure for a joint of a body limb comprising an outer shield supported by internal bracing and cushioning devices so arranged that the shock of any blow upon said shield is fully distributed over the area surrounding the protected joint.

12 Claims, 2 Drawing Figures

PROTECTIVE STRUCTURES FOR JOINTS

BACKGROUND OF THE INVENTION

1. Field of the Invention

The invention relates to a novel, light weight, body joint guard suitable for wear by a participant in sports events and the like.

The present invention relates more specifically to a protection for use over an articulation or joint such as a knee or elbow.

In various sports such as hockey, basketball, etc. there has been a need for a practical, light weight, and effective protective structure for various joints, particularly, knee joints, where hard contact between solid objects such as a wall; floor; etc. or other participants is involved. During such sports contests, the knee joint linking the femur and the tibial bones is highly vulnerable to injury or damage or, if initially hurt, to reinjury. Commonly, injuries occur via severe impact forces directly upon the kneecap or applied to either side of the knee which can result in an over-extension of the joint.

2. Description of the Prior Art

Articulations of the body are sensitive and easily injured. As a result, there have been many attempts to design protective gear for these areas.

Much of the prior art is concerned with protection against large forces being slowly applied to a joint but not sudden impacts upon said joint. Knee and elbow rests for working in fields, or on any hard surfaces, are examples of these devices which are exemplified in U.S. Pat. Nos. 1,293,240; 1,753,055; 1,796,234 and 2,456,472. Because of the normally slow application of pressure upon a given joint associated with, e.g., the kneeling-type end uses of these protectors, these guards are not overly concerned with the distribution of forces about the joint, but rather allow pressure to be placed directly upon said joint albeit most do try to realize a uniform distribution of pressure, i.e., they all possess a pad of some sort in direct contact with the joint per se.

More specific to the problem obviated by the instant invention, i.e., injury caused by severe impact upn a joint are U.S. Pat. Nos. 1,772,922; 3,259,910 and 3,712,299 which disclose guards designed specifically for protection during sporting events, i.e., protection against sudden impact.

U.S. Pat. No. 1,772,922 of Volz relates to a limb guard device useful for protecting parts of the body such as thighs, from bruises resulting from the effect of a blow or sudden pressure during athletic sports participation. The disclosure describes a padded, rigid frame supported by the body area surrounding the limb region it is desired to protect. Arched over this rigid frame and secured thereto at its opposite edges is the guard or shield proper. A suitable harness holds the protection in place. It is obvious that the Volz device is designed for use over unarticulated portions of the body for the rigid subframe would prevent the user from full use of a joint. In addition to the retardation of flexibility of the joint, any effort to counteract the reinforcement of the frame by the wearer would assuredly result in chafing and bruising of the body areas within the frame and strap contact.

U.S. Pat. No. 3,259,910 relates to a rather sophisticated and bulky protection gear for covering joints. The primary front protection resides in a longitudinally curved plastic plate with a generally "U"-shaped cross-section in the latitudinal direction sandwiched between two layers of foam plastic, foam rubber, or the like padding material. The essence of the disclosure lies in the lateral part of the protector, i.e., the parts along either side of the joint; for each lateral part is provided with a deep "V"-shaped notch in the central part thereof defined by curved converging edges. In this manner, when the protector is bent, the edges simply move toward and over one another.

A layer of foam-like material is in the immediate contact with the limbs above and below the joint and a central circular hole is povided for receiving the joint edge proper which serves to maintain the protector in position. In addition, however, another piece of padding is inserted in the hole between the joint and the primary front protector for further padding the elbow edge.

Thus, a device is disclosed with multiple moving as well as stationary parts resulting in a relatively expensive and cumbersome guard. Furthermore, through a sequence of flexible and rigid layers, it is contemplated that padding will be brought into direct contact with the joint proper.

U.S. Pat. No. 3,712,299 discloses a protective knee guard adapted to be secured to the tibial and femur portions of a knee joint. The device has a pair of spaced leg straps which fasten as described above and which are coupled to elongated spring steel members provided on each side of the joint. The elongated members are maintained in a bowed condition by flexible chain members. A series of guards coupled to the spring steel members extends forwardly of the joints for protection.

Although the guard/shields do not contact the joint directly, one can readily see that when the joint is in a flexed position, it would be relatively easy for a pointed object such as the toe of a boot or shoe to penetrate between the shields and impact the joint proper. The inventor obviously recognized this problem for he suggests covering the outside of the curved outer guards "at least partially by an elastic fabric." Such a covering would not suffice to stop a pointed object from impacting upon the joint. Furthermore, the structure offers very little side protection and it is apparent that the rigid guard members, bowed side members, side chains and backbrace rod are all capable in themselves of rendering an injury to the joint area.

BRIEF SUMMARY OF THE INVENTION

This invention is directed to a novel guarding structure adapted to protect a body joint from injury as a result of sudden, high impact pressures as is common in contact sports. The unit is non-bulky, light in weight, inexpensive and durable. It allows complete flexibility of movement of the joint and yet does not permit any contact with the joint per se from either the device itself or an external object.

It offers complete protection to the side of a joint and, during use, there is not a rigid member in continuous contact with either the joint itself or the immediate surrounding area. In addition, the device is extremely effective in transmitting and distributing forces directed toward the joint to the upper and lower limb extensions thereof.

The instant invention which accomplishes the above-described objectives comprises a truncated ovate shield generally shaped to conform to the sides and front of a semi-flexed joint when spaced a distance therefrom by flexible supporting means whose sides, top and bottom, are fully adjustable to conform to the area surrounding said joint. The supporting means, by remaining in intimate contact with the area surrounding said joint during flex, is able to more uniformly distribute impact forces upon the shield than heretofore described protection devices. Furthermore, the instant invention will permit the limbs to be extended, i.e., the joint unflexed, without difficulty. For example, in the case of a knee guard, the wearer can easily stand or walk unencumbered.

The foregoing and other important objects and advantages of the instant invention will become more apparent during the course of the following detailed description.

DETAILED DESCRIPTION OF THE INVENTION

Figure 1:
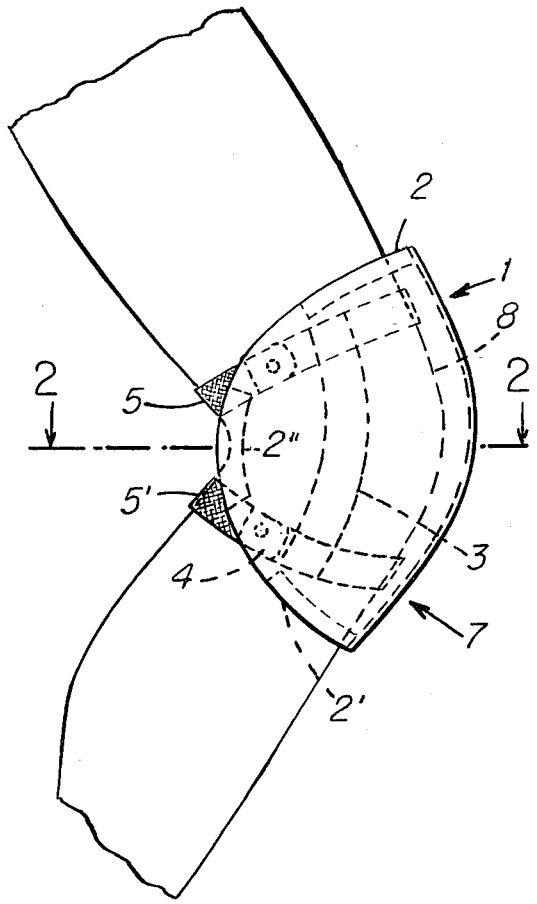
FIG. 1 is a side elevational view of the instant device operationally placed on a wearer's knee.

Referring to the drawings, FIG. 1 shows a knee guard 7 constructed in accordance with the principles of the present invention and applied to the knee 8 of a wearer in a semi-flexed position. However, it is to be understood that the guard of the present invention may be applicable for guarding elbow joints as well. Therefore, while the specific embodiment will be referred to as a knee guard and will be described in conjunction with a knee joint, it is to be understood that the device may be equally as effective for guarding other joints such as an elbow joint.

The instant invention can be generally considered to be comprised of four sub-units: the protective shield, the internal bracing and cushioning devices; fasteners and the means for attaching the above to the user.

The shield (1) is shaped to conform generally to the portion of the joint (8) it is designed to protect but it is considerably larger than said joint so as to be spaced therefrom a substantial distance on the front and two sides. This distance permits insertion of the internal bracing and cushioning means and avoids contact even in the fully flexed position of the joint with the shield. In most instances, the shield will be gently curved about the joint from one limb extension of said joint to the other limb, i.e., arcuate in the longitudinal direction. All cross-sections of the shield from one side of the joint to the other, i.e., latitudinally are generally "U"-shaped. The sides are generally of a truncated triangular nature so as to completely protect the sides of the joint and avoid sharp corners projecting rearward of the shield. The front of the shield preferably has no edges so as to avoid causing injury to another during body contact.

The shield may, of course, be of any stiff material, that is, one rigid enough to withstand the shocks to which it is exposed or subjected, such as a metal, but it is preferred that it be of a comparatively light weight material such as a synthetic resin. Typical of such resins are the nylons; polyesters; polyoxymethylenes; cellulose nitrate and acetate; etc. which, of course, can be filled with, for example, glass fibers to improve the stiffness.

The inner edges of the shield are preferably padded with foam-like, rubber strips or the like (2, 2', 2'') to avoid injury to the areas surrounding the joint such as the thigh (6) from an off-center sudden impact when the joint is in a flexed position (or any impact in an unflexed position) and to provide comfort to the wearer, i.e., avoid chafing when the joint is unflexed.

The internal bracing and cushioning devices (3) are so arranged that the shock on any blow of the shield (1) is distributed over the stiff material of the shield and is resisted by the area surrounding the joint to be protected by means that serve as flexible body-conforming straps that spread the pressure over the area surrounding the joint and prevent direct contact between the joint and the shield thus cushioning and reducing to a minimum any injury to the wearer from such shocks.

Figure 2:
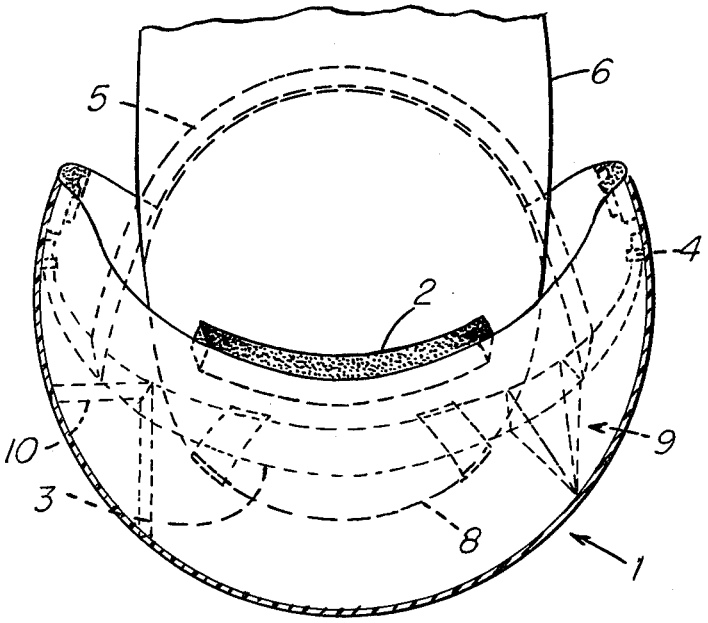
FIG. 2 is a cross-sectional view taken along line 1—1 of FIG. 1 viewing down upon the thigh of a wearer.

Depicted in FIG. 1 and FIG. 2 is a straight forward means for accomplishing the bracing and cushioning of the instant invention. The bracing and cushioning members are mainly made of stout, flexible straps of appropriate material such as non-stretchable fabric tape; webbing or appropriate substitutes therefore. A significant criteria with regard to the bracing and cushioning members is that they be sufficiently flexible as to remain in substantially continuous contact with the area surrounding the joint during flexing movement of said joint so as to be able to more uniformly distribute the impact, energy forces transmitted from the shield.

The figures depict the bracing and cushioning straps fastened to the shield toward the rear of the joint. This is preferred since in this manner more of the strap surface is in contact with the limbs surrounding the joint. It is also envisioned that contacts be made via straps or other flexible means to the shield at other points on the bracing and cushioning means. These other connections serve not only to aid in the transmitting of impact forces to the main cushioning device but, in addition, serve to maintain the shield in a central position vis-a-vis the joint. Typical additional strap configurations are "V"-shaped whereby the apex is fastened to the shield and the two ends of the "V" strap are sequentially fastened on the periphery to the main bracing strap(s) or vice versa (see FIG. 2 Items 9 and 10).

The means (4) by which the bracing and cushioning device is fastened to the shield can be simply rivets but the attachment is preferably via detachable-type fasteners such as snap or lock fit fasteners. This enables one to select a cushioning means suitable to a give joint size and also permits removal of the cushioning means for cleaning. Needless to say, these fasteners must be capable of withstanding anticipated impacts without releasing.

Also preferred are means to adjust the bracing and cushioning straps individually so as to achieve a more perfect fit around the joint area for a given individual Velcro ™-type fastening devices (Velcro is a trademark of Velcro U.S.A. Inc.) are very suitable for this purpose for they are able to withstand impact forces which put sudden high tension upon the cushioning means; are easily adjustable and possess no rigid edges that could injure flesh.

As in conventional constructions, the protecter is normally held in place around the joint by means of elastic bands (5, 5') or the like which preferably are secured to the bracing and cushioning means just forward of the place where said cushioning means is attached to the shield. In this manner said bands aid in not only maintaining the shield in place but ensure that the bracing and cushioning means is held snugly and that it conforms throughout its circumferential lengths to—and in intimate contact with—the area surrounding the joint. Normally, all of the straps of the cushioning means are under tension via the fastening bands when the device is in position over the knee.

It is also contemplated that the elastic bands could be attached directly to the shield at the rear of said shield, however, the more preferred design is that formerly described whereby tension is applied directly to the cushioning means. The bands preferably should be rather wide to avoid pressing same into the flesh or interfering with blood circulation in the limbs.

In general, the ability of the structure to withstand shocks is a function of the strength of the shield to resist bending and compressive strains and of the tensile strength of the cushioning means to brace the shield and to transmit the strains to the area surrounding the joint. Thus, for any particular shield material, the thickness and/or stiffness of the shield wall determines the number, length or span of the individual strap units. A thinner shield may require more straps and shorter spans between straps to approximate a given resistance to blows than would a thicker shield.

It is also contemplated that the shield be perforated to allow ventilation and/or dirt removal. Additionally, if desired, although not necessary, the inside of the shield can have a foam padding which although not to be in contact with the joint surface at any time during normal use is available to afford some protection in case of catastrophic failure of the bracing and cushioning means or inadvertent entrance of a foreign object, e.g., a stone, between the shield and the joint per se.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as claimed.

What I claim is:

1. A protective structure for a joint of a body limb comprising:

a. a rigid shield;

b. bracing and cushioning means;

c. fasteners for attaching said bracing and cushioning means to said shield; and d. means for attaching said shield, bracing and cushioning means and fasteners to the user whereby said rigid shield generally conforms in shape to the front and sides of said joint in semi-flexed configuration albeit larger; is continuous; and entirely surrounds the area to be protected; and said bracing and cushioning means comprise body-conforming flexible straps which are in substantially intimate contact with the limbs surrounding the joint area and suspend said shield in non-contacting relationship to said joint.

2. A protective structure according to claim 1 whereby said rigid shield contains holes to permit foreign object removal and ventilation.

3. A protective structure according to claim 1 whereby said means for attaching said shield; bracing and cushioning means; and fasteners to the user comprises bands which are attached to the bracing and cushioning means.

4. A protective structure according to claim 3 whereby said bands are elastic.

5. A protective structure according to claim 1 whereby said means for attaching said shield; bracing and cushioning means; and fasteners to the user comprises bands which are attached to said shield.

6. A protective structure according to claim 5 whereby said bands are elastic.

7. A protective structure according to claim 1 whereby said shield contains an inner padded wall said padding never in contact with said joint in normal use.

8. A protective structure according to claim 1 whereby said shield has protective padding on portions of the inside periphery to avoid injury to the limb area surrounding the joint.

9. A protective structure according to claim 1 whereby said fasteners releasably secure said bracing and cushioning means to said shield.

10. A protective structure according to claim 1 whereby said body-conforming flexible straps which are in substantially intimate contact with the limb surrounding the joint area possess "V"-shaped straps between said body-conforming straps and said shield whereby the ends of the "V"-shaped straps are attached sequentially around the periphery of said body-conforming straps and the apexes of said "V"-shaped straps are attached to the inside of said shield to aid the suspension of said shield about said body-conforming straps and to normally apply a tensional strain to all said body-conforming straps when structure is in place around said joint.

11. A protective structure according to claim 1 whereby said body-conforming flexible straps which are in substantially intimate contact with the limbs surrounding the joint area possess "V"-shaped straps between said body-conforming straps and said shield whereby the ends of the "V"-shaped straps are attached sequentially around the inside of said shield and the apexes of said "V"-shaped straps are attached to the periphery of said body-conforming straps.

12. A protective structure according to claim 1 whereby said bracing and cushioning straps comprise non-stretchable fabric tape.

* * * * *